United States Patent [19]

Rumsey et al.

[11] Patent Number: 4,952,434

[45] Date of Patent: Aug. 28, 1990

[54] CUSHIONING FLOOR MAT

[75] Inventors: Roger L. Rumsey, Wichita; Jorge O. Andreo, Belle Plaine, both of Kans.

[73] Assignee: Balco International, Inc., Wichita, Kans.

[21] Appl. No.: 259,540

[22] Filed: Oct. 18, 1988

[51] Int. Cl.[5] ..... B32B 3/06; B32B 3/10

[52] U.S. Cl. ..... 428/54; 428/60; 428/53; 15/215; 52/180

[58] Field of Search ..... 428/53, 54, 58, 60; 15/215, 216; 52/180, 177

[56] References Cited

U.S. PATENT DOCUMENTS

| | | | |
|---|---|---|---|
| 2,795,001 | 6/1957 | Wood | 15/215 |
| 4,663,903 | 5/1987 | Ellingson | 428/53 |
| 4,675,222 | 6/1987 | Berndt | 428/53 |
| 4,766,020 | 8/1988 | Ellingson | 428/54 |

FOREIGN PATENT DOCUMENTS

| | | | |
|---|---|---|---|
| 518359 | 11/1955 | Canada | 15/215 |
| 610533 | 12/1960 | Canada | 52/180 |

*Primary Examiner*—Alexander S. Thomas

*Attorney, Agent, or Firm*—Hovey, Williams, Timmons & Collins

[57] ABSTRACT

A floor mat is disclosed which provides a flexible, resilient, cushioned, tread surface and substantial foreign matter collection area. The preferred floor mat includes a plurality of elongated, flexible, resilient, spaced-apart, intercoupled rails. Each preferred rail includes a plurality of elongated, upstanding, spaced-apart cleaning structures extending upwardly from the rail top surface with a transverse wall between adjacent cleaning structures which together cooperatively define respective collection troughs. Each transverse wall includes a plurality of foreign matter removal openings and each rail includes a plurality of elongated, longitudinally disposed passageways extending substantially along the length of each rail and positioned respectively beneath a corresponding cleaning structure for cushioning impact on the cleaning structures.

19 Claims, 1 Drawing Sheet

CUSHIONING FLOOR MAT

BACKGROUND OF THE INVENTION

1.Field of the Invention

This invention relates to a floor mat having flexible rails wherein each rail includes cushioned cleaning structures and a plurality of removal openings between adjacent structures.

2. Description of the Prior Art

A variety of grills, grates, grids and mats for floors have been developed for removing dirt, water, and other foreign matter from the footwear of persons walking thereover. Such devices are typically placed adjacent the entrances of buildings in order to prevent intrusion of such foreign matter.

Some types of prior art floor mats provide a number of upstanding cleaning structures such as ridges or the like which dislodge foreign matter from footwear as a person steps thereon. The capacity of such floor mats to accumulate foreign matter is generally limited by the amount which can be retained in the spaces between the cleaning structures.

Other types of prior art floor mats resemble spaced-apart, interconnected rubber coated links which provide spaces between the links to accumulate foreign matter. Such floor mats, however, do not provide effective upstanding cleaning structures to dislodge foreign matter from the footwear of persons walking thereover.

To solve these problems some prior art floor mats incorporate sections of carpet or upstanding fibers which are effective in dislodging foreign matter from footwear and are also effective in providing a cushioned surface which flexes when trod upon and which enhances the cleaning ability of the carpet or fiber. Such carpet-type floor mats are ideal for many applications but are more difficult to clean than rubber or vinyl floor mats and are usually more expensive. Additionally, carpettype floor mats are typically not reversible.

SUMMARY OF THE INVENTION

The problems with prior art floor mats as outlined above are solved by the floor mat in accordance with the present invention. More particularly, the present invention provides a floor mat having enhanced capacity for dislodging and accumulating foreign matter and which provides a flexible, cushioned, tread surface.

Broadly speaking, the floor mat hereof includes a plurality of elongated, flexible, intercoupled rails. Each rail includes a plurality of elongated, upstanding, spaced-apart cleaning structures which extend upwardly from the upper surface of the rail substantially along the length thereof for dislodging foreign matter from the footwear of persons trodding thereon. A transverse wall is disposed between each adjacent pair of dislodging structures and together therewith define a respective collection trough for collecting foreign matter therein. Additionally, a plurality of removal openings are defined in each transverse wall for passage of foreign matter therethrough in order to remove the foreign matter from the corresponding collection trough in order to enhance the capacity of the floor mat to accumulate foreign matter.

In preferred forms, each rail includes a plurality of elongated passageways defined therein respectively beneath each dislodging structure to cushion impact thereon and to allow flexing of the cleaning structures in order to enhance their foreign matter dislodging capability.

In particularly preferred forms, each rail includes a plurality of collection troughs with corresponding removal openings defined in the transverse walls thereof in order to maximize the removal opening area. Other preferred aspects are explained further hereinbelow.

BRIEF DESCRIPTION OF THE DRAWING FIGURES

DETAILED DESCRIPTION OF THE PREFERRED EMBODIMENT

Figure 1:
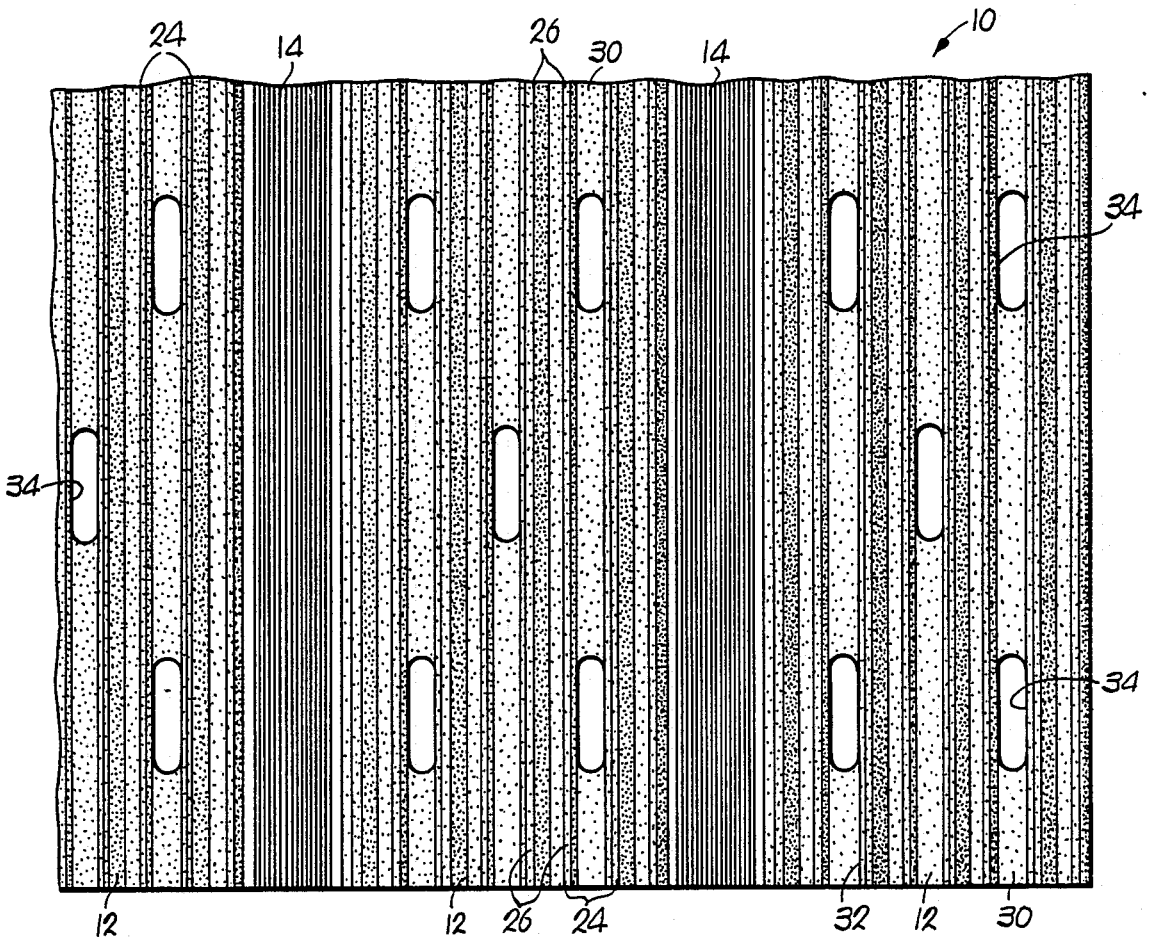
FIG. 1 is a partial plan view of the preferred floor mat.

Referring now to the drawing figures, preferred floor mat 10 broadly includes rails 12 and coupling members 14 intercoupling adjacent ones of rails 12.

Each rail 12 is preferably of unitary construction formed from extruded vinyl for flexibility, resilience, durability, and economical manufacture. Rails 12 can be advantageously formed of other synthetic resin materials or high durometer rubber.

Each preferred rail 12 is transversely and longitudinally symmetrical for reverseability and presents respective, upper and lower, opposed surfaces 16 and 18, and respective, left and right, opposed side edges 20 and 22.

Upper surface 16 includes a plurality of elongated, upright, spaced-apart, cleaning structures 24 with each configured to present a pair of upstanding, spaced-apart, cleaning ridges 26. Cleaning ridges 26 of floor mat 10 cooperatively define tread surface 28 which together provide the contact and support surface for the footwear of a person stepping on floor mat 10.

Adjacent cleaning structures 24 are separated by respective transverse walls 30. Each transverse wall 30 and adjacent cleaning structures 24 cooperatively define a corresponding collection trough 32 for receipt of foreign matter therein which has been dislodged by the associated cleaning structures 24.

Each transverse wall 30 includes a plurality of elongated, longitudinally spaced, removal openings 34 defined therein, through rail 12, and through the corresponding, opposed, transverse wall 30 of lower surface 18 of rail 12. The number of removal openings 34 is maximized to the extent the structural integrity and strength of rail 12 will allow in order to maximize the foreign matter removal capability of floor mat 10.

The placement of removal openings 34 along the bottom of each collection trough 32 removes foreign matter collected therein especially moisture resulting from dislodged snow or the like in order to keep collection troughs 32 open. This enhances the foreign matter collection capability of floor mat 10. As best viewed in FIG. 1, removal openings 34 of adjacent transverse walls 30 are arranged in staggered rows to maintain the structural integrity of each rail 12 while maximizing the number of removal openings 34.

Figure 2:
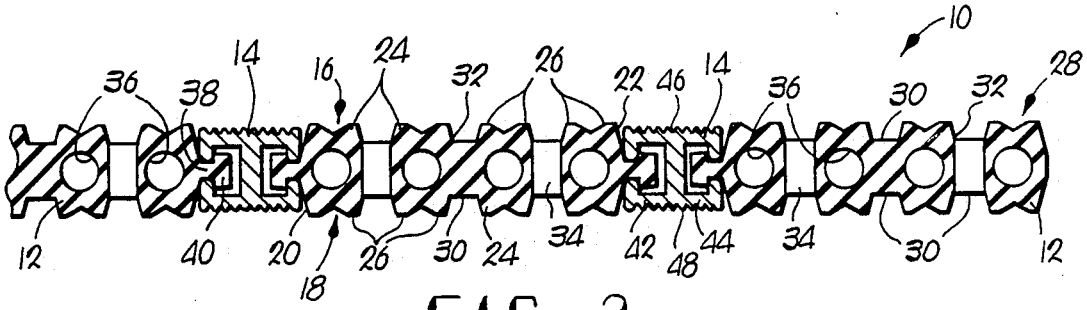
FIG. 2 is a partial sectional view of the floor mat of FIG. 1.
Figure 3:
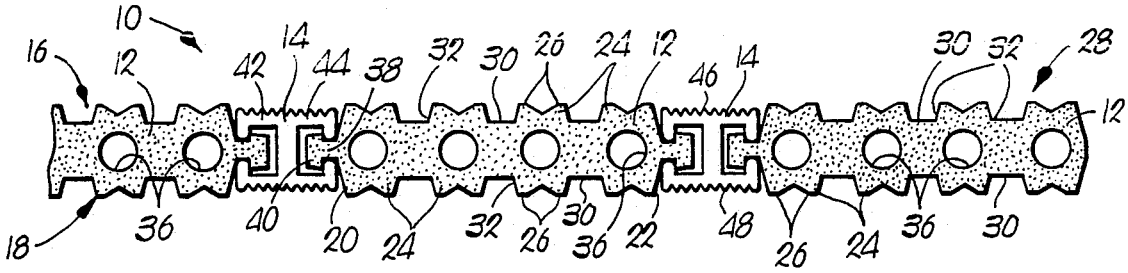
FIG. 3 is a partial end view of the floor mat of FIG. 1.

Each rail 12 also includes a plurality of elongated cushioning passages 36 defined along the length thereof, each presenting a circular cross-sectional configuration. Each cushioning passage 36 is located between corresponding, opposed, cleaning structures 24 as shown in FIGS. 2 and 3. Cushioning passages 36 increase the downward flexibility of cleaning structures 24 when a person steps thereon. Additionally, when a person steps on floor mat 10 thereby downwardly displacing a given cleaning structure 24, the associated pair of cleaning ridges 26 move inwardly toward one another to provide a scrapping action relative to the footwear of the person stepping onto floor mat 10. This enhances the foreign matter dislodging capability of floor mat 10. Passages 36 also allow manufacture of a lighter weight floor mat and allow more economical manufacture by reducing the amount of vinyl required.

Each side edge 20, 22 presents an outwardly extending, T-shaped coupling stem 38 which extends substantially along the length of rail 12. Each stem 38 also includes stem flange 40 as shown in FIGS. 2 and 3.

Coupling members 14 are preferably constructed of extruded aluminum or other substantially rigid metal or synthetic resin material. Each coupling member 14 is integrally formed to include respective left and right, C-shaped in cross-section, coupling sections 42 and 44, and further presents grooved, non-skid, top and bottom faces 46 and 48.

As viewed in FIGS. 2 and 3, coupling sections 42 and 44 open outwardly and oppositely from one another and receive respective coupling stems 38 from adjacent rails 12 therein. This configuration allows relative longitudinal movement between sections 42, 44 and associated rails 12 for ease and convenience in coupling and uncoupling but prevents relative lateral movement.

FIGS. 2 and 3 illustrate that the thickness of coupling member 14, that is, the dimension between faces 46 and 48, is less than the overall thickness of rails 12 between opposed cleaning ridges 26. This arrangement effectively prevents contact between the footwear of a person stepping on floor mat 10 and coupling member 14 which increases the likelihood that dislodged foreign matter will be collected in collection troughs 32 rather than on coupling member 14. This cooperative interaction further enhances the foreign matter collection capability of floor mat 10.

Additionally, the side-to-side dimension of coupling member 14 is substantially less than the side-to-side dimension of each rail 12 and in particular is approximately equal to the width of a given cleaning structure 24 plus associated transverse wall 30. That is to say, each rail 12 is preferably at least three times the width of a coupling member 14. By providing a relatively wide rail 12, the net effective tread surface 28 of floor mat 10 is maximized which correspondingly maximizes the number of removal openings 34 and thus the foreign matter removal capability of floor mat 10.

As those skilled in the art will appreciate, floor mat 10, with removal opening area maximized, is especially effective in removing and collecting moisture such as snow. For example, in use, collection troughs 32 can collect substantial amounts of snow which, upon melting, pass through removal openings 34 thereby clearing and cleaning collection troughs 32. This restores the foreign matter collection capability of floor mat 10.

With prior art formats, once the available collection spaces are filled with foreign matter, the removal and collection capability is reduced requiring manual cleaning. The floor mat of the present invention, however, provides a greater cleaning and collection capability thus reducing the frequency required for cleaning.

Having thus described the preferred embodiment of the present invention, the following is claimed as new and desired to be secured by Letters Patent:

1. A floor mat for removing foreign matter from footwear of a person stepping thereon, said floor mat comprising:

a plurality of elongated, flexible, resilient, spaced-apart rails; and coupling means for intercoupling adjacent ones of said rails, each of said rails including an upper surface, a plurality of elongated, upstanding, spaced-apart, cleaning structures extending upwardly from said upper surface and substantially along the length of said rail for dislodging foreign matter from the footwear of a person stepping on said floor mat, a respective transverse wall disposed between each adjacent pair of said cleaning structures, each transverse wall and adjacent pair of cleaning structures defining a corresponding collection trough for collecting foreign matter therein dislodged by said cleaning structures, and means defining a plurality of removal openings in each transverse wall and through said rail for passage of foreign matter therethrough in order to remove foreign matter from a corresponding collection trough.

2. The floor mat as set forth in claim 1, each of said rails further including means defining a plurality of elongated, spaced-apart, cushioning passages extending substantially along the length of said rail and respectively positioned beneath a corresponding one of said cleaning structures.

3. The floor mat as set forth in claim 1, said rails each presenting a width substantially greater than the width of said coupling means in order to maximize the number of said removal openings in said floor mat.

4. The floor mat as set forth in claim 3, said rails each presenting a width about three times as great as the width of said coupling means.

5. The floor mat as set forth in claim 1, each of said transverse walls and one adjacent cleaning structure presenting a combined width approximately equal to the width of said coupling means.

6. The floor mat as set forth in claim 1, each of said rails including four cleaning structures and three collection troughs.

7. The floor mat as set forth in claim 1, each of said cleaning structures including at least one upstanding, cleaning ridge.

8. The floor mat as set forth in claim 7, each of said cleaning structures including a pair of said cleaning ridges, each of said cleaning structures being configured such that downward shifting of a respective cleaning structure causes movement of the associated pair of cleaning ridges relative to one another thereby resulting in movement of said ridges relative to the footwear of a person stepping on said floor mat.

9. The floor mat as set forth in claim 1, said coupling means being composed of metal.

10. The floor mat as set forth in claim 9, said coupling means being composed of aluminum.

11. The floor mat as set forth in claim 1, said coupling means including a pair of adjacent, oppositely opening, C-shaped in cross-section, coupling sections, each of said rails including a sidewise extending, T-shaped, coupling stem for reception within a respective corresponding coupling channel.

12. The floor mat as set forth in claim 1, each of said rails presenting a bottom surface presenting substantially the same configuration as said top surface.

13. The floor mat as set forth in claim 1, said coupling means presenting a top face, said cleaning structures cooperatively presenting a tread surface for engagement by footwear of a person stepping on said floor mat, said tread surface being disposed at a higher level than said coupling top face.

14. The floor mat as set forth in claim 1, said removal openings being elongated, said removal openings of a corresponding transverse wall being axially aligned and spaced-apart.

15. The floor mat as set forth in claim 1, each of said rails including at least two of said transverse walls with corresponding removal openings defined therein.

16. The floor mat as set forth in claim 1, each of said rails including a lower surface and a plurality of said cleaning structures extending therefrom for defining a lower tread surface in order to allow reversible use of said floor mat.

17. The floor mat as set forth in claim 1, said flexible material including synthetic resin material.

18. The floor mat as set forth in claim 17, said synthetic resin material including vinyl.

19. The floor mat as set forth in claim 17, said rails being integrally formed of extruded vinyl.

* * * * *